US010739093B2

(12) United States Patent
Hogan, Jr.

(10) Patent No.: US 10,739,093 B2
(45) Date of Patent: Aug. 11, 2020

(54) INCREASED CAPACITY MAGAZINE FOR USE WITH A FIREARM

(71) Applicant: R. Russell Hogan, Jr., Pacific, MO (US)

(72) Inventor: R. Russell Hogan, Jr., Pacific, MO (US)

( * ) Notice: Subject to any disclaimer, the term of this patent is extended or adjusted under 35 U.S.C. 154(b) by 0 days.

(21) Appl. No.: 16/203,776

(22) Filed: Nov. 29, 2018

(65) Prior Publication Data

US 2019/0162496 A1 May 30, 2019

Related U.S. Application Data

(60) Provisional application No. 62/592,502, filed on Nov. 30, 2017.

(51) Int. Cl.
*F41A 9/70* (2006.01)
*F41A 9/69* (2006.01)

(52) U.S. Cl.
CPC . *F41A 9/70* (2013.01); *F41A 9/69* (2013.01)

(58) Field of Classification Search
CPC ..... F41A 9/69; F41A 9/70
USPC ..... 89/33.04
See application file for complete search history.

(56) References Cited

U.S. PATENT DOCUMENTS

| | | | | |
|---|---|---|---|---|
| 3,226,869 | A | 1/1966 | Musgrave | |
| 3,672,089 | A * | 6/1972 | Silsby | F41A 9/69 42/50 |
| 4,520,585 | A | 6/1985 | Barrett | |
| 4,589,218 | A | 5/1986 | Teppa | |
| 5,782,157 | A | 7/1998 | Ellington et al. | |
| 6,257,115 | B1 | 7/2001 | Balsavage et al. | |
| 7,533,483 | B1 | 5/2009 | Alzamora et al. | |
| 8,061,071 | B2 | 11/2011 | Fitzpatrick et al. | |
| 8,813,406 | B1 * | 8/2014 | Sullivan | F41A 9/69 42/50 |
| 2011/0173857 | A1 * | 7/2011 | Hogan, Jr. | F41A 9/68 42/50 |

FOREIGN PATENT DOCUMENTS

DE 3422334 A1 12/1985

* cited by examiner

*Primary Examiner* — Stephen Johnson
(74) *Attorney, Agent, or Firm* — Armstrong Teasdale LLP

(57) ABSTRACT

A follower assembly for an ammunition feeding device is provided. The follower assembly includes a follower body including a bottom surface. The follower assembly also includes a floating pivot coupled to the follower body. The follower assembly further includes a first pontoon and a second pontoon. The first pontoon and the second pontoon are each attached to the floating pivot. By the first pontoon and the second pontoon's attachment to the floating pivot, the first pontoon and the second pontoon are selectively moveable relative to said follower body via the floating pivot.

20 Claims, 7 Drawing Sheets

INCREASED CAPACITY MAGAZINE FOR USE WITH A FIREARM

CROSS REFERENCE TO RELATED APPLICATIONS

This application claims priority to and the benefit of the filing date of U.S. Provisional Application No. 62/592,502 filed on Nov. 30, 2017, which is hereby incorporated by reference in its entirety.

BACKGROUND

The field of the present disclosure generally relates to firearm components, and more particularly to an increased capacity magazine for use with firearms.

Magazines for firearms, and in particular, military style rifles are fairly consistent in their design, shape, and capacity. For example, STANAG, also known as a NATO Standard, magazines are often similar in design, shape, and capacity. At least one reason for their similarity is to maintain substantially the same weight and balance of the rifle. Another design consideration is that certain military shooting techniques, such as a prone shooting position, may limit a maximum length that the magazine can protrude from the rifle. For example, if the magazine is too long, the overall dimensions of the magazine and rifle system may cause the magazine to undesirably strike the ground. These considerations and many others may limit the internal capacity of such magazines.

Other design considerations may include the functionality and/or reliability of the magazine. Specifically a magazine must enable the systematic and orderly feeding of ammunition into the weapon. Most magazines having an increased capacity incorporate an alternating pattern of ammunition, or a "double stack" design. However, such designs generally do not meet the dimension requirements described herein. At least some other magazines having an increased capacity require an increased mechanical complexity as compared to a double stack magazine design. For example, at least some known magazines accomplish increased capacity by feeding ammunition from two or more alternating patterns of stacks of ammunition. However, generally, such magazines including those known as "quad-stack" magazines, may typically have decreased reliability due to mechanical failures. Therefore, it would be desirable to provide a reliable high capacity magazine that is not mechanically complex and that satisfies the design requirements that enable it to be used with existing weapons.

BRIEF DESCRIPTION

In one aspect, a follower assembly for an ammunition feeding device is provided. The follower assembly includes a follower body including a bottom surface. The follower assembly also includes a floating pivot coupled to the follower body. The follower assembly further includes a first pontoon and a second pontoon. The first pontoon and the second pontoon are each attached to the floating pivot. By the first pontoon and the second pontoon's attachment to the floating pivot, the first pontoon and the second pontoon are selectively moveable relative to said follower body via the floating pivot.

In another aspect, a follower assembly for an ammunition feeding device is provided. The follower assembly includes a follower body including a bottom surface. The follower assembly also includes a floating pivot. The floating pivot includes a bracket rigidly coupled to the follower body and a pivotable component pivotally coupled to the bracket. The follower assembly also includes a first pontoon and a second pontoon. The first pontoon and the second pontoon are attached to the follower body via the pivotable component.

In a further aspect, an ammunition feeding device is provided. The ammunition feeding device includes a magazine body that defines an interior space. The magazine body is made up of a front endwall with a front guide that extends into the interior space, a rear endwall with a rear guide that extends into the interior space, and two opposing sidewalls coupled to the front and rear endwall. The ammunition feeding device also includes a follower assembly configured to travel within the interior space in a substantially planar fashion. The follower assembly includes a follower body defining a front slot that engages the front guide of the magazine body and a rear slot that engages the rear guide of the magazine body. The follower body also includes a pivotable component rotationally coupled to the follower body, a first pontoon attached to the follower body via the pivotable component, and a second pontoon attached to the follower body via the pivotable component. The first pontoon and the second pontoon are rotationally coupled to the follower body via the pivotable component.

DETAILED DESCRIPTION

Figure 1A:
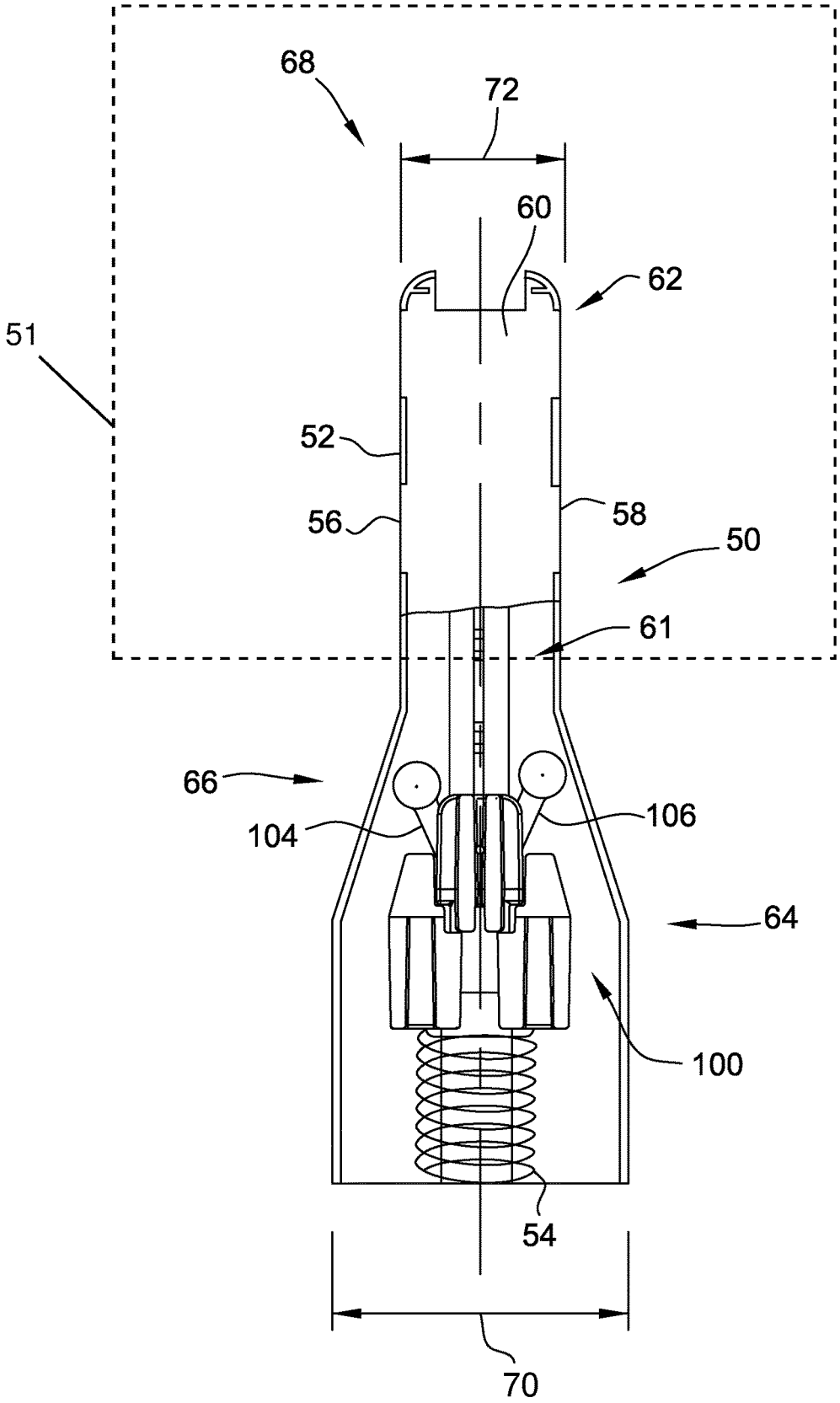
FIG. 1A is a rear view of an exemplary ammunition magazine for a firearm.

Exemplary applications of increased capacity magazines for use with firearms are described herein. These examples are being provided solely to add context and to aid in the understanding of the described embodiments. It will thus be apparent to one of ordinary skill in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

An exemplary follower for use with an ammunition magazine is provided. In the exemplary embodiment, the follower includes a floating pivot that, in some embodiments, can be a single component or alternatively can be assembled from a plurality of components coupled together to form the follower assembly. For example, in one embodiment the follower can include at least a follower body, a floating pivot assembly, a first pontoon, and a second pontoon. In one exemplary embodiment, the first and second pontoons are rotationally coupled to the floating pivot. More specifically, the pontoons can couple to the follower body via the floating pivot assembly in such a manner that enables the first and second pontoons to each rotate from a substantially horizontal-configuration to a substantially vertical-configuration. In the exemplary embodiment, the floating pivot enables the first and second pontoons to travel relative to the follower assembly, independently of the rotational coupling. For example, in one embodiment, the floating pivot can include a bracket and a pivotable component that can be rotationally coupled to the bracket. In such an embodiment, the first and second pontoons can be rotationally coupled to the pivotable component, and the bracket can be coupled to the follower body. In some embodiments, the first and second pontoons can engage ammunition. Because the pontoons are provided with a degree of freedom and movement independently from the follower body, the floating pivot, when used in a magazine, can enable the ammunition to essentially "float within the magazine" thereby reducing friction between adjacent ammunition cartridges. Moreover, reducing friction between ammunition cartridges facilitates reducing "conflicts" between cartridges as compared to at least some known ammunition magazines, and as such, facilitates improved reliability of the magazine. Moreover, the reduced friction reduces wear on the magazine and thus facilitates extending the useful life of the magazine.

In one embodiment, the follower assembly, including the floating pivot, is one of several components used in a magazine. The magazine can be a STANAG, also known as a NATO Standard, compatible magazine. However, as those skilled in the art will recognize, the follower assembly is not limited to only being used with a NATO Standard compatible magazine, and rather can be used with any ammunition magazine for use in a firearm. For example, the follower assembly may be used in a quad stack magazine to facilitate increasing the reliability of the quad stack magazine. In the exemplary embodiment, the magazine assembly includes a top section formed with a width that is approximately the same as that of standard STANAG magazine, a lower section formed with a width that is about twice as wide as the width of a standard STANAG magazine, and a transition section that extends between the top and lower sections. Moreover, in the exemplary embodiment, the magazine includes at least a magazine body, a removable baseplate, a mechanical spring, and the follower assembly. Any or all of the components of the magazine can be fabricated from a metallic material, a composite material, a plastic material, and/or any combination of materials that enable the magazine assembly to function as described herein.

Each component in the magazine can be an assembly that is fabricated from a plurality of pieces. The magazine body can include a front endwall, rear endwall, and two opposing sidewalls that are joined together via a series of teeth and slots, welding, and/or any other coupling method that enables the follower assembly to function as described herein. The top of the magazine body may define feed lips and the bottom of the magazine body may accept a removable baseplate. The mechanical spring and the follower assembly may be located in an interior of the magazine body. In the exemplary embodiment, the mechanical spring contacts the baseplate to bias the follower assembly towards the top of the magazine body. For example, in one embodiment, the mechanical spring biases the follower to travel in a substantially linear direction towards the top of the magazine. When the follower assembly is located in the bottom section of the magazine body, the first and second pontoons are in substantially horizontal position. When loaded with ammunition, the first and second pontoons cooperate with mechanical features extending from the follower body to engage the outer casing of the ammunition cartridge and to selectively feed the ammunition cartridge from the magazine.

These and other embodiments are discussed below with reference to FIGS. 1A-8. However, those skilled in the art will readily appreciate that the detailed description given herein with respect to these figures is for explanatory purposes only and should not be construed as limiting.

Figure 1B:
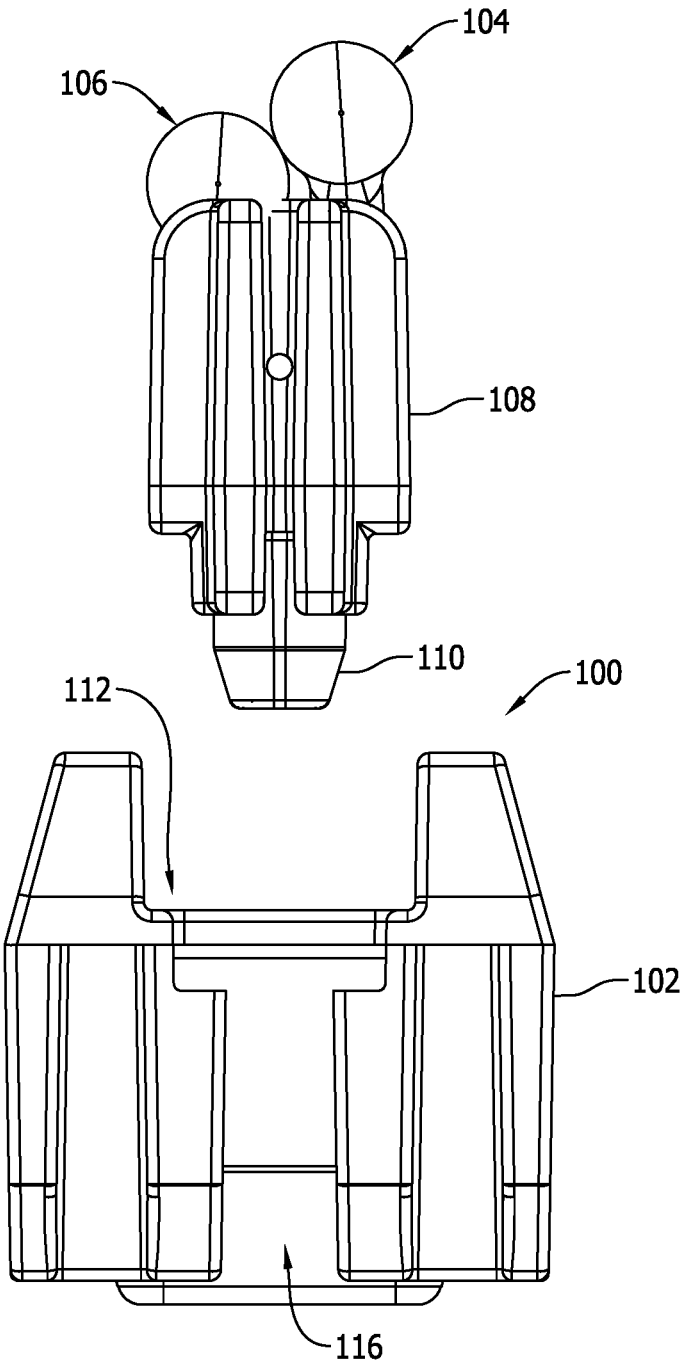
FIG. 1B is an exploded end view of an exemplary follower assembly for use in the magazine of FIG. 1A.
Figure 2:
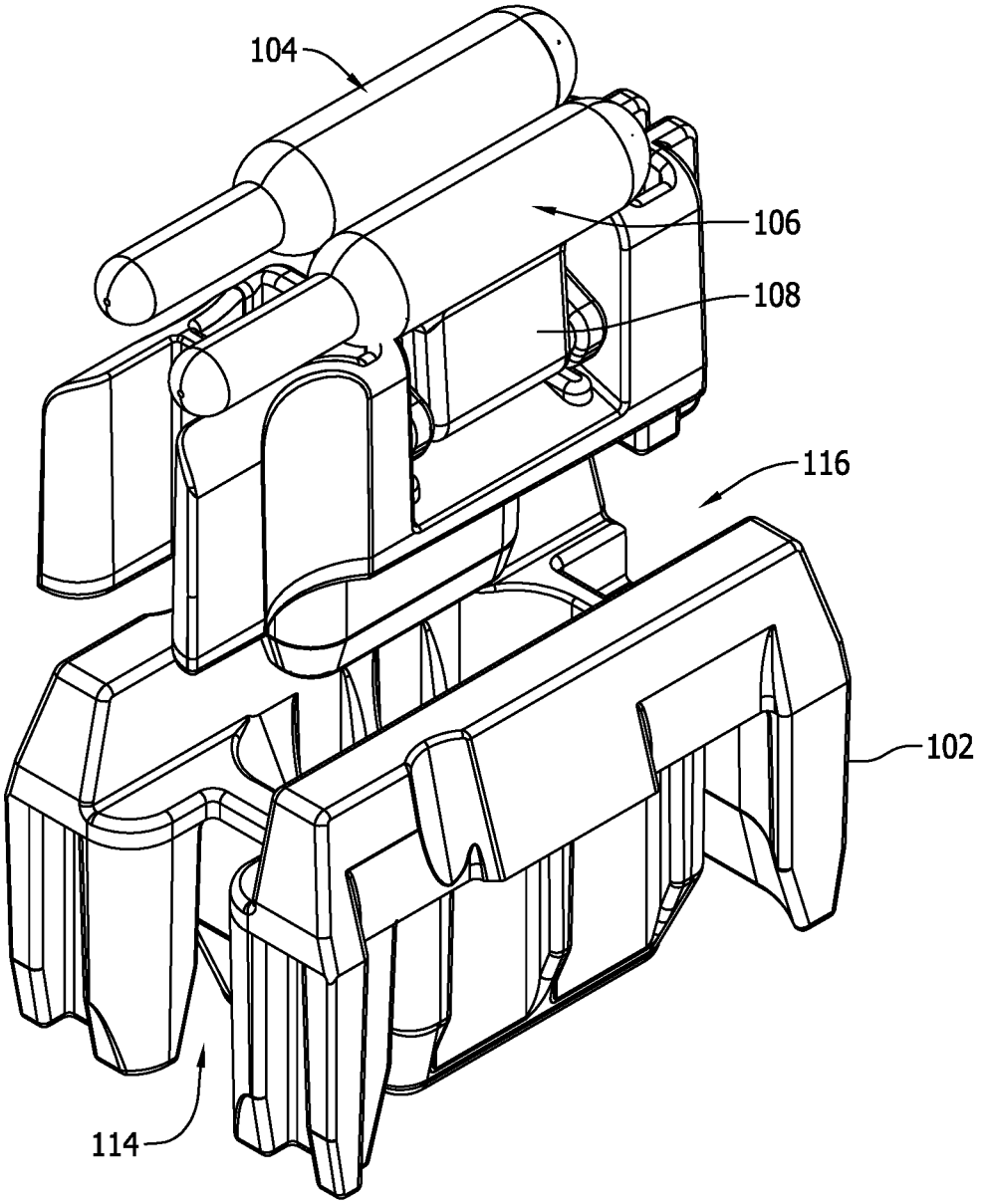
FIG. 2 is a perspective view of the follower assembly shown in FIG. 1B.
Figure 3:
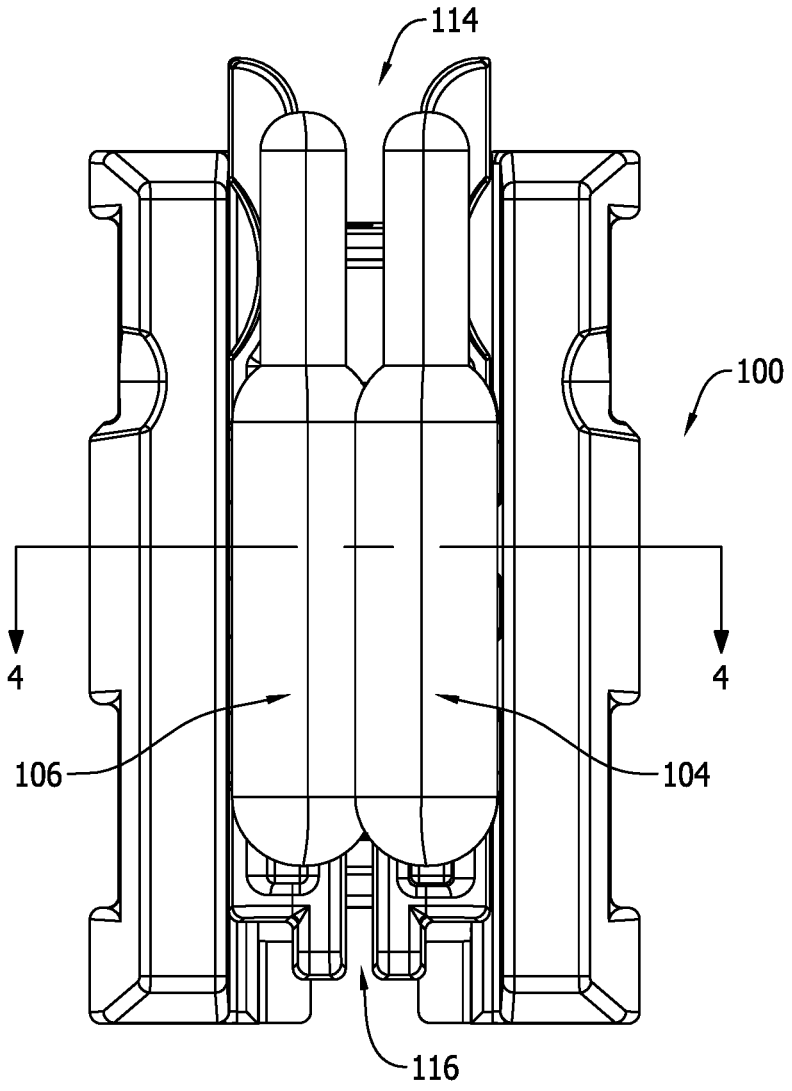
FIG. 3 is a top view of the follower assembly shown in FIGS. 1B-2.

FIG. 1A is a rear cutaway view of one embodiment of magazine 50 and follower assembly 100. FIG. 1B is an exploded end view of a follower assembly 100 that may be used with magazine 50. FIG. 2 is a perspective view of follower assembly 100, and FIG. 3 is a top view of follower assembly 100. In the exemplary embodiment, magazine 50 includes magazine body 52, biasing mechanism 54, and follower assembly 100. Alternatively, in other embodiments, magazine 50 can include an additional component or components that enable magazine 50 to function as described herein. Magazine body 52 includes a front endwall (not shown), a pair of oppositely-disposed sidewalls 56 and 58, and a rearwall 60. The front endwall, sidewalls 56 and 58, and rearwall 60 cooperate to define an interior space 61. Specifically, in the exemplary embodiment, sidewalls 56 and 58 are coupled opposite each other and extend between the front endwall and rearwall 60. Front endwall and rearwall 60 can include guides (not shown) that extend into interior space 61 for engaging features on magazine 50. In some embodiments, the guides can engage a front slot 114 and/or a rear slot 116 when follower assembly 100 is inserted into magazine body 52.

In the exemplary embodiment, magazine body 52 includes a top section 62, a bottom section 64, and a transition section 66 that extends between top and bottom sections 62 and 64, respectively. Top section 62 can engage with a rifle or other firearm 51, as is well known in the art. More specifically, in the exemplary embodiment, top section 62 includes feed lips 68 and a retaining feature (not shown) that enables magazine 50 to be retained within a firearm 51. Additionally, top section 62 can be sized to fit inside a magazine well of a firearm 51, such as a military style rifle. As shown in FIG. 1A, bottom section 64 is formed with a wider width 70 than a width 72 of top section 62. In the exemplary embodiment, top section width 70 is sized and selected to enable two somewhat overlapping rows of ammunition (not shown) to be received therein. In contrast, in the exemplary embodiment, bottom section width 70 is sized and selected to enable two separate columns of two overlapping rows of ammunition to be received therein.

In the exemplary embodiment, follower assembly 100 includes a follower body 102. Follower body 102 may be formed with any shape that enables follower assembly 100 to function as described herein. In the exemplary embodiment, follower assembly 100 includes a pair of pontoons 104 and 106 coupled to follower assembly 100. More specifically, pontoons 104 and 106 are each rotatably coupled to follower body 102 via a bracket 108 and a pivotable component (not shown in FIGS. 1-3). In the exemplary embodiment, bracket 108 is coupled to follower body 102 via interlocking features 110 and 112. In other embodiments, bracket 108 can be rigidly coupled to follower body 102 via fasteners, adhesive, a welding process, and/or any other coupling method that enables follower assembly 100 to function as described herein. In some embodiments, bracket 108 and follower body 102 can be fabricated as a unitary single component rather than multiple components coupled together. However, separating bracket 108 from follower body 102 may be desirable to facilitate cleaning and maintenance. Slots 114 and 116 are formed in opposite ends of follower body 102. Slots 114 and 116 cooperate to function as a keyed feature that prevents the insertion of follower assembly 100 into a magazine body at an incorrect orientation.

As such, slots 114 and 116 essentially "murphy-proof" the assembly of magazine 50. For example, in the exemplary embodiment, front slot 114 and rear slot 116 sized to enable the insertion of follower assembly 100 into a magazine body 52 in only one orientation. Moreover, the size and orientation of follower body 102 and slots 114 and 116 ensure that follower assembly 100 is only properly inserted into a correct magazine body 52. As those skilled in the art will recognize, the fact that follower assembly 100 can only be inserted into magazine 50 in one orientation results in a design that cannot be misused inherently. Specifically, in military applications for example, a person with minimal training will be able to disassemble, clean, and reassemble magazine 50 utilizing follower assembly 100 without the risk of incorrect reassembly.

When magazine 50 is fully assembled, magazine follower assembly 100 travels in a substantially linear fashion within interior space 61. In the exemplary embodiment, biasing member 54 limits the travel of magazine follow assembly 100. More specifically, biasing member 54 is positioned within interior space 61 between follower assembly 100 and a lower surface 113 of magazine body 52. Further, in the exemplary embodiment, biasing mechanism 54 is a mechanical spring that extends between follower assembly 100 and bottom section 64 of magazine body 52. In alternative embodiments, biasing mechanism 54 can be any configuration and dimension that enables follower assembly 100 to function as described herein. Moreover, biasing mechanism 54 is not limited to being a spring, but rather can be any component that enables follower assembly 100 to function as described herein. In the exemplary embodiment, biasing mechanism 54 biases follower assembly 100 from bottom section 64 towards top section 62. When ammunition is inserted into magazine top section 62, biasing mechanism 54 also biases the ammunition towards top section 62 and feed lips 68.

It should be noted that magazine 50 does not require any additional major components other than magazine body 52, biasing mechanism 54, and follower assembly 100, such as for example, a divider (not shown) located in the transitional section 66. Further, as the overall shape of magazine body 52 transitions from the dimensions of bottom section 64 to the dimensions of top section 62, pontoons 104 and 106 will tend to move along the inner surface 115 of magazine body 52, and more particularly, the inclined inner surface 115 of transitional section 66, as follower assembly 100 travels as ammunition is inserted or removed from magazine 50. It should be noted because pontoons 104 and 106 are rotatably coupled within follower assembly 100, pontoons 104 and 106 tend to "float" relative to each other. For example, as follower assembly 100 travels within magazine 50, pontoons 104 and 106 engage the inner surface 115 of sidewalls 56 and 58. As ammunition is loaded from top section 62, pontoons 104 and 106 enable the orderly combination of two separate columns of staggered cartridges into a single column of staggered ammunition cartridges.

Figure 4:
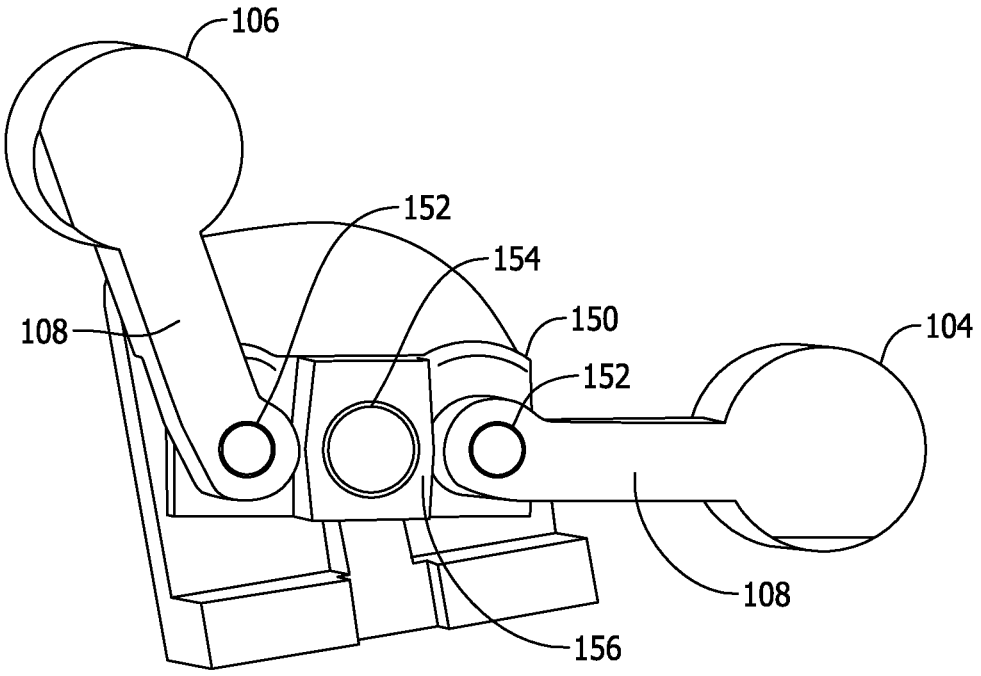
FIG. 4 is a cutaway view of the follower assembly shown in FIG. 3 and taken along line 4-4.

FIG. 4 is a cross-sectional view of exemplary follower assembly 100 taken along line 4-4 and with follower body 102 removed. In the exemplary embodiment, follower assembly 100 includes a pivotable component 150, bracket 108, and pontoons 104 and 106. Pivotable component 150 is rotatably coupled to bracket 108. Pontoons 104 and 106 are also rotatably coupled to bracket 108 via pivotable component 150. In other embodiments, pontoons 104 and 106 can be coupled to pivotable component 150 and/or pivotable component can be coupled to bracket 108 in any other manner that enables follower assembly 100 to function as described herein. Pontoons 104 and 106 are rotatably coupled to follower assembly via pontoon attachment points 152 and bracket attachment point 154. The combination of attachment points 152 and bracket attachment point 154 enable pontoons 104 and 106 to move independently of each other and to float within magazine 50. In some embodiments attachment points 152 and 154 are each a fastener, such as, but not limited to, a metallic rod or hook coupled to pivotable component 150 and to bracket 108. In other embodiments attachment points 152 and 154 can be formed into pivotable component 150 and bracket 108 via a molding or casting process. Pivotable component 150 includes a mechanical engagement feature 156 that is sized to enable a friction fit with bracket 108 while also facilitating disassembly for cleaning and maintenance.

Figure 5:
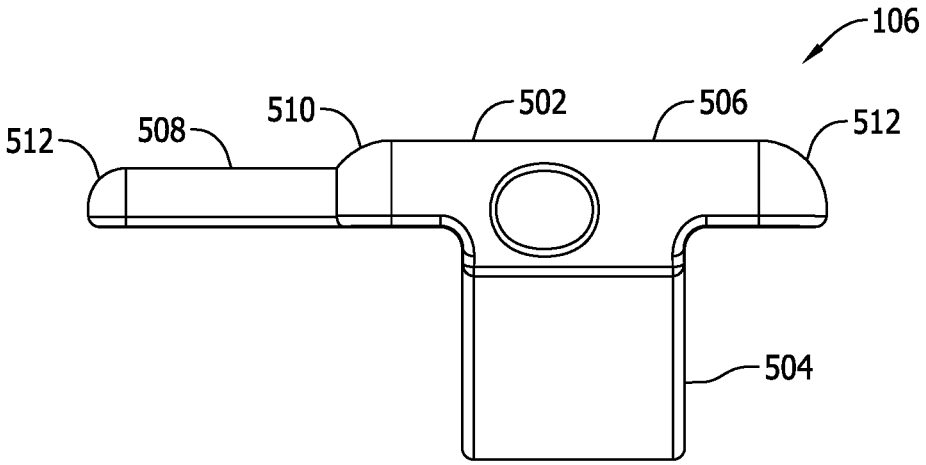
FIG. 5 is a side view of an exemplary pontoon that may be used with the follower assembly shown in FIGS. 1B-4.

FIG. 5 is a side view of pontoon 106. In the exemplary embodiment, pontoons 104 and 106 are substantially identical. Alternatively, pontoons 104 and 106 can include the same general features, but differ in dimensions. In further alternative embodiments, pontoons 104 and 106 can be any shape, configuration, and dimension that enables follower assembly 100 to function as described herein. In the exemplary embodiment, pontoons 104 and 106 each include a roller section 502 and swingarm 504. As such in the exemplary embodiment, because pontoons 104 and 106 are substantially identical, each pair of roller sections 502 are substantially identical and each pair of swingarms 504 are substantially identical. Roller section 502 includes a large diameter section 506, a small diameter section 508, and a transitional section 510 that extends and transitions between sections 506 and 508. Notably, in the exemplary embodiment, roller section 502 generally resembles an ammunition casing which aids in engaging ammunition. Alternatively, roller section 502 may have any other shape that enables follower assembly 100 to function as described herein. For example, in the exemplary embodiment, the shape of roller section 502 helps an interaction between pontoons 104 and 106 and adjacent to ammunition casings as ammunition is loaded in magazines utilizing follower assembly 100. Moreover, features such as rounded edges 512 as well as other features facilitate "smoothing" the feeding of ammunition by follower assembly 100, thus facilitating thereby increasing the reliability of magazines using follower assembly 100.

In the exemplary embodiment, each swingarm 504 also extends from attachment point 152 (shown in FIG. 4) and as such, is rotatably coupled to pivotable component 150. In addition to facilitating floating, attachment point 152 also facilitates an ease of assembly/disassembly. More specifically, pontoons 104 and 106 can each be uncoupled from pivotable component 150 via attachment point 152 in order to facilitate cleaning and/or maintenance. In alternative embodiments, a length, orientation, and or shape of each swingarm 504 can be varied to enable roller sections 502 to be staggered with respect to one another when follower assembly 100 is fully assembled. Furthermore, in the exemplary embodiment, follower assembly 100 when utilized in a magazine assembly, such as magazine 50 is designed to be positioned in a staggered fashion when follower assembly 100 is located adjacent to, or within, top section 62 of magazine 50.

Figure 6:
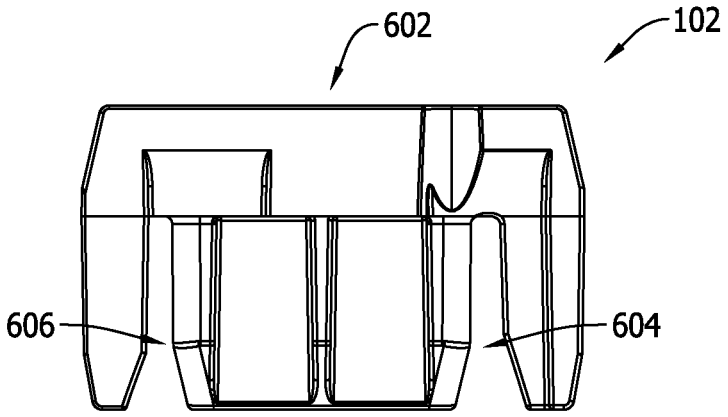
FIG. 6 is a side view of an exemplary follower body used with the follower assembly shown in FIGS. 1B-4.

FIG. 6 is a side view of follower body 102. Follower body 102 includes a mechanical engagement feature 602, a front slot 604, and a rear slot 606. Alternatively, follower body 102 can include any number of engagement features and/or have any other shape that enables follower assembly 100 to function as described herein. When assembled, front slot 604 forms a portion of front slot 114, and rear slot 606 forms a portion of rear slot 116. In some embodiments, front slot 604 can be sized and oriented to form a front guide (not shown) of a magazine body and rear slot 606 can be oriented to correspond to a rear guide (not shown) of a magazine body.

Figure 7:
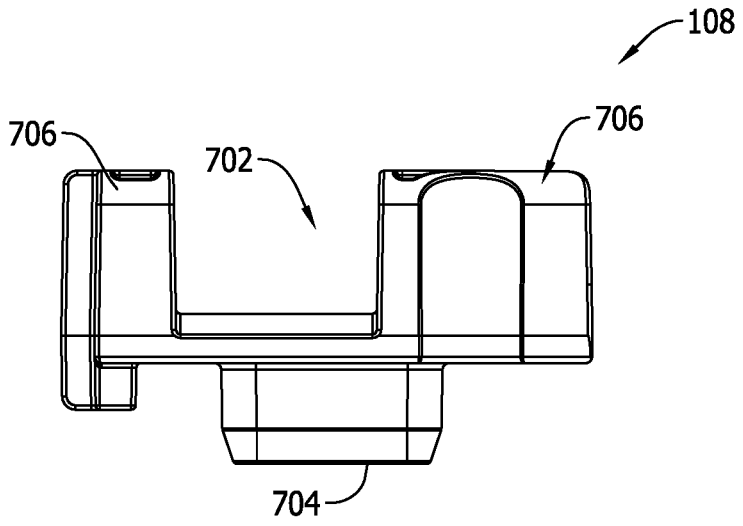
FIG. 7 is a side view of an exemplary bracket for use with the follower assembly shown in FIGS. 1B-4.

FIG. 7 is a side view of bracket 108. Bracket 108 includes a pocket 702, a mechanical engagement feature 704, and inclined surfaces 706. Alternatively, bracket 108 can include any number of other features that enables follower assembly 100 to function as described herein. For example, bracket 108 can include attachment features such as, but not limited to, drilled and/or tapped holes accessible from pocket 702. Pocket 702 can be sized to receive at least a portion of swingarm 504 of pontoon 104 therein. For example, a metal bar (not shown) could be provided to extend about pocket 702 to enable pivotable component 150 to pivotally couple with bracket 108.

Bracket 108 engagement feature 704 can cooperate with and/or engage mechanical engagement feature 602 of follower body 102. Moreover, bracket 108 includes inclined surfaces 706 that are useful during transitions of pontoons 104 from a substantially horizontal position (not shown) to a substantially vertical position as shown in FIG. 1A. Specifically, in the exemplary embodiment, inclined surfaces 706 can engage ammunition in a magazine utilizing follower assembly 100. For example, in magazine 50 when follower assembly 100 is present in bottom section 64, mechanical engagement feature 704 and inclined surfaces 706 can engage ammunition.

Figure 8:
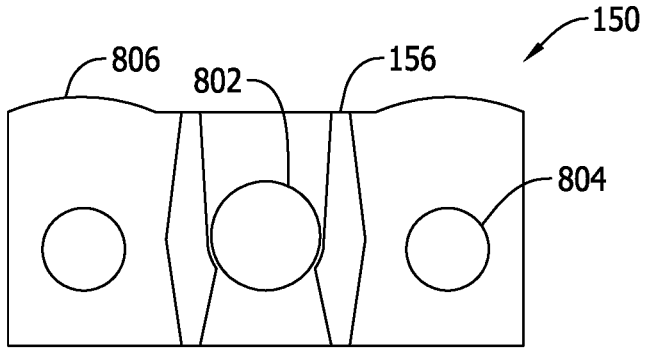
FIG. 8 is a side view of an exemplary pivotable component that may be used with the follower assembly shown in FIGS. 1B-4.

FIG. 8 is a side view of pivotable component 150 and also illustrates mechanical engagement feature 156. Alternatively, pivotable component 150 can include any number of other features that enable follower assembly 100 to function as described herein. Mechanical engagement feature 156 is sized and oriented to provide a friction fit with bracket 108 while also facilitating disassembly and/or assembly of pivotable component 150 from/to bracket 108, cleaning, and maintenance. Mechanical engagement feature 156 also includes a hole 802 formed therein. Hole 802 can be a through-hole, and can be sized and oriented to cooperate with mechanical engagement feature 156 to enable an interface with bracket 108. Pivotable component 150 also includes receptacles 804 that can couple to swingarm section 504 of pontoons 104 and 106. As depicted, receptacles 804 can be molded in a portion of pivotable component 150. Alternatively, receptacles 804 can also be formed from metal in order to reduce wear and friction between pivotable component 150 and pontoons 104 and 106. Further alternatively, receptacles 804 can also be any other shape or component, such as hook receptacles, that enables follower assembly to function as described herein. Moreover, pivotable component 150 can include curved portions 806 to further facilitate reducing friction between pivotable component 150 and pontoons 104 and 106.

The above described embodiments provide an increased ammunition capacity for rifles, pistols, and specialized weapons and ammunition without requiring an increased length magazine which provides such benefits as described herein. Specifically, the described embodiments enable an increased capacity by feeding ammunition from two or more alternating patterns of stacks of ammunition. Moreover, the embodiments described a simplified construction as compared to known magazines. For example, the magazine assembly described herein does not require a divider below the follower assembly to enable function. Further, the magazine described herein facilitates increased reliability as compared to previous magazines. The magazine achieves increased reliability by enabling the follower to constantly contact and control of the ammunition during loading and feeding phase of the magazine and rifle system. This enables the correct stacking of the ammunition and compatibility with quad stack or multiple stack magazines.

The above described embodiments further provide an increased ammunition capacity while maintaining substantially the same weight and balance of a firearm. For example, certain military shooting techniques, such as a prone shooting position, limit a maximum length that the magazine can protrude from the rifle. If the magazine is too long, the overall dimensions of the magazine and rifle system may cause the magazine to undesirably strike the ground. Previously, these considerations and many others have limited the internal capacity of such magazines. Additionally, the above described embodiments accomplish increased capacity by feeding ammunition from two or more alternating patterns of stacks of ammunition which are also known as "quad-stack" magazines. The above described embodiments enable the function reliable function of so-called "quad-stack" magazines.

The various aspects, embodiments, implementations or features of the described embodiments can be used separately or in any combination. The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms recited. It will be apparent to one of ordinary skill in the art that many modifications and variations are possible in view of the above teachings.

Exemplary embodiments of magazine architecture are described above in detail. Although the magazine architecture are herein described and illustrated in association with a specific follower assembly, the invention is also intended for use with other magazines. Moreover, it should also be noted that the components of the follow assembly and magazine architecture are not limited to the specific embodiments described herein, but rather, aspects of each component may be utilized independently and separately from other components and methods of assembly described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A follower assembly for use with an ammunition feeding device, said follower assembly comprising:

a follower body comprising a bottom surface;

a floating pivot rotatably coupled to said follower body;

a first pontoon; and a second pontoon, said first pontoon and said second pontoon coupled to said floating pivot such that said first and second pontoons are selectively moveable relative to said follower body via the floating pivot.

2. A follower assembly in accordance with claim 1 further comprising a biasing mechanism positioned against said follower body bottom surface for biasing said follower assembly within the ammunition feeding device.

3. A follower assembly in accordance with claim 1 further comprising a first swingarm and a second swingarm, said first swingarm couples said first pontoon to said floating pivot, said second swingarm couples said second pontoon to said floating point.

4. A follower assembly in accordance with claim 3 wherein at least one of said first swingarm and said second swingarm is rotabaly coupled to said floating pivot.

5. A follower assembly in accordance with claim 3 wherein said first swingarm has a first length, said second swingarm has a second length that is different from said first length.

6. A follower assembly in accordance with claim 1 wherein said first pontoon is independently moveable relative to said second pontoon.

7. An ammunition feeding device for use with a weapon, said ammunition feeding device comprising:

a magazine body defining an interior space therein; and a follower assembly sized for insertion within said magazine body interior space, said follower assembly configured to travel within said magazine interior space to facilitate feeding ammunition into the weapon, said follower assembly comprising:

a follower body;

a pivotable component rotatably coupled to said follower body;

a first pontoon coupled to said follower body via said pivotable component; and a second pontoon coupled to said follower body via said pivotable component such that said first and second pontoons are each selectively movable relative to said follower body to engage ammunition in said feeding device.

8. An ammunition feeding device in accordance with claim 7 wherein at least one of said first pontoon and said second pontoon is rotatably coupled to said pivotable component.

9. An ammunition feeding device in accordance with claim 7 further comprising a biasing mechanism configured to bias said follower assembly within said magazine body.

10. An ammunition feeding device in accordance with claim 7 wherein said follower body comprises a front slot and a rear slot opposite said front slot, each said slot sized and oriented to engage a portion of said magazine body.

11. An ammunition feeding device in accordance with claim 10 wherein said slots facilitate insertion of follower assembly within said magazine body in a proper orientation.

12. An ammunition feeding device in accordance with claim 7 wherein said magazine body is used with a NATO standard, compatible magazine.

13. An ammunition feeding device in accordance with claim 12 wherein an upper portion of said magazine body has a first width and a lower portion of said magazine body has a second width that is about twice as wide as said upper body first width.

14. An ammunition feeding device in accordance with claim 7 wherein said follower assembly facilitates reducing friction between adjacent ammunition cartridges when said device contains ammunition.

15. A follower assembly for use with an ammunition feeding device, said follower assembly comprising:

a follower body;

a bracket rigidly coupled to said follower body;

a pivotable component rotatably coupled to said bracket;

a first pontoon rotatably coupled to said said pivotable component; and a second pontoon rotatably coupled to said pivotable component, said second pontoon selectively moveable relative to said follower body and relative to said first pontoon.

16. A follower assembly in accordance with claim 15 further comprising a a pair of swingarms, a first of said pair of swingarms couples said first pontoon to said pivotable component, a second of said swingarms couples said second pontoon to said pivotable component.

17. A follower assembly in accordance with claim 16 wherein said first swingarm has a first length, said second swingarm has a second length that is different from said first length.

18. A follower assembly in accordance with claim 17 wherein said first pontoon is in a staggered orientation relative to said second pontoon, such that said first pontoon is offset from said second pontoon.

19. A follower assembly in accordance with claim 15 wherein said follow assembly facilitates reducing friction between adjacent ammunition cartridges in said magazine.

20. A follower assembly in accordance with claim 15 wherein said first and second pontoons facilitate reducing conflicts between ammunition cartridges.

* * * * *